United States Patent [19]

Lagerkvist

[11] 4,284,196

[45] Aug. 18, 1981

[54] TUBULAR CONTAINER FOR VISCOUS, VISCOUS-ELASTIC, PLASTIC PRODUCTS AS WELL AS FOR POWDER OR GRANULAR PRODUCTS

[75] Inventor: Conny B. Lagerkvist, Nora, Sweden

[73] Assignee: Nitro Nobel AB, Gyttorp, Sweden

[21] Appl. No.: 74,305

[22] Filed: Sep. 11, 1979

[30] Foreign Application Priority Data

Oct. 4, 1978 [SE] Sweden ..... 7810386

[51] Int. Cl.[3] ..... B65D 71/08; B65D 85/00

[52] U.S. Cl. ..... 206/528; 206/432; 206/497; 229/DIG. 5; 229/DIG. 12

[58] Field of Search ..... 138/96 T, 89, 91; 220/201; 206/528, 276, 315 B, 316, 333, 364, 365, 384, 385, 407, 413, 415, 432, 530, 497; 215/231, 232, 234, 250, 364, 246; 229/DIG. 12, DIG. 5

[56] References Cited

U.S. PATENT DOCUMENTS

| | | | |
|---|---|---|---|
| 1,809,267 | 6/1931 | Cushin | 206/415 |
| 2,372,177 | 3/1945 | Conner | 229/DIG. 5 |
| 2,529,644 | 11/1950 | Webber | 220/201 |
| 2,889,951 | 6/1959 | Hennings | 215/231 |
| 3,095,972 | 7/1963 | Sorenson | 206/365 |
| 3,342,611 | 9/1967 | Hunter | 215/231 |
| 3,401,632 | 9/1968 | Griffith et al. | 102/318 |
| 3,768,636 | 10/1973 | O'Connell | 215/231 |
| 3,899,100 | 8/1975 | Rigand | 206/407 |
| 3,980,224 | 9/1976 | Yasuda | 229/DIG. 5 |

FOREIGN PATENT DOCUMENTS

| | | |
|---|---|---|
| 1050358 | 12/1966 | United Kingdom . |
| 1058362 | of 0000 | United Kingdom . |
| 1143841 | 2/1969 | United Kingdom . |
| 1396655 | 6/1975 | United Kingdom . |
| 1476306 | 6/1977 | United Kingdom . |

*Primary Examiner*—Herbert F. Ross

*Attorney, Agent, or Firm*—Hane, Roberts, Spiecens & Cohen

[57] ABSTRACT

It has been found that fluid, semi-fluid, plastic products as well as powder or granular products packed in plastic tubes have caused great problems in tropical countries due to the change in temperature between day and night. In some cases the products have expanded and burst open the closure of the plastic tube so that the contents ran out or, due to their constituents, the products have caused deterioration of the protective properties of the plastic tube. By choosing a plastic tube or olefin plastic and sealing said plastic tube with closures of olefin plastic, as well as orientating the plastic molecules in the tube in both axial and radial direction, a plastic seal is obtained which is not affected by the products enclosed and which also resists expansion of the products without rupturing.

12 Claims, 6 Drawing Figures

TUBULAR CONTAINER FOR VISCOUS, VISCOUS-ELASTIC, PLASTIC PRODUCTS AS WELL AS FOR POWDER OR GRANULAR PRODUCTS

FIELD OF THE INVENTION

The present invention relates to a tubular plastic container for a product which may be viscous, viscous-elastic, plastic or consist of a powder which may be fine or coarse-grained. The container is conventionally provided at each end with a closure which is retained by folding in the ends of the container so that an inwardly directed flange is obtained.

PRIOR ART

Such a tubular container may consist of PVC. Such a container has been widely used, for instance, in the Scandinavian countries for explosives such as gelatin explosives sold under the trademark DYNAMEX. Other powderlike explosives may also be packed in such tubular containers. Such powdered explosives are sold under the trademarks NABIT and GURIT. Considerable problems have been encountered with tubular explosive containers described above which have been delivered to countries with tropical climates. Due to their constituents, the explosives have affected the surrounding plastic casing in the tropical climate so that the container has softened, thus loosing its stiffness making it impossible to insert into a drill hole.

Since explosives normally contain ammonium nitrate, one of the five crystal conversion points of this being at about 32° C., this has led to innumerable crystal conversions taking place when the explosive is stored in a plastic tube. As a result the explosive expands and causes the end closures of the containers to burst open. After about 20 crystal conversions, the explosive may have increased in volume by 6–8 percent. Once the end closures have been broken, the explosive charges are of no further use. The explosive is exposed when the end closures have been broken and, upon crystal conversion, it is able to absorb unlimited amounts of moisture so that it loses its plasticity and becomes stiff and solid. The explosive must be plastic inasmuch as a drill hole may not always be straight but may be deflected to a certain extent.

SUMMARY OF THE INVENTION

An object of the present invention is to solve the problems mentioned above which arise in tropical climates and the present invention relates to a tubular container, closed at both ends and intended for a product which may be viscous, viscous-elastic, plastic or a powder which is either fine or coarse-grained. The problem is solved by choosing a plastic which is an olefin plastic or a plastic having the same properties as olefin plastic. Furthermore, in the tubular part of the container the olefin plastic should have the plastic molecules orientated in both axial and radial direction; the latter formed in solid phase, i.e. below the melting point of the plastic. A molecule may have substantially the appearance of a sine curve and such a curve may be orientated in various ways in relation to the axis of the plastic tube. If the molecules are shaped in this way they will not contract when subjected to heat. This may be expressed by saying that a plastic tube with such molecules has lost its elastomeric memory. According to the invention, such a tube shall be sealed with end closures of the same material as the tube itself and the end closures shall be secured at the ends of the tube so that the tube is hermetically sealed when it has been filled with a product.

The olefin plastic preferably consists of polypropylene which has the property of being insensitive to the ingredients of an explosive.

Since the plastic molecules are radially oriented in solid phase in the manner described above and not tensioned, a tube made of polypropylene can expand in longitudinal direction without breaking. Furthermore, such a tube can also withstand shock stress due to the elasticity provided by the unstressed polypropylene molecules.

Polypropylene also has the valuable property of having extremely low permeability to water.

Since the polypropylene tube includes unstretched molecules, the explosive enclosed in such a tube can expand without the surrounding tube being destroyed.

The closures for the tube are made of the same material as the tube itself and are in the form of an inverted lid provided with a tubular part. The two lids are inserted in the ends of the tube and the tube parts welded to the inner surface of the tubular container, preferably by means of ultrasonic welding, the material of the closure and that of the surrounding tube being totally welded together at the welding points. This is because a tube manufactured in accordance with the above has no elastomeric memory which means that when the plastic molecules are orientated in the manner described above, the tube has lost its ability to contract when subjected to heat.

It may be advisable to provide the tubular part of each closure with one or more outwardly directed ridges around the tube by means of which each closure is welded to the relevant end of the tubular container. If at least two peripheral ridges are used for each closure, an absolutely tight seal is obtained.

Each end closure is provided in the center with a protuberance facing inwardly in relation to the surrounding tube and provided with rupture indications. A detonater can be passed through said protuberance and held in position.

In accordance with the invention, the plastic used may be polypropylene PP but in certain cases it is advisable to use a copolymer consisting of polypropylene PP and HD-polypropylene (PEHD). The proportions between these monomers should be such that the HD-polyethylene constitutes about 10–40%, preferably 15%. The aim in using a copolymer is to bring down the glass temperature in the final product to below at least −10° C., preferably −50° C.

BRIEF DESCRIPTION OF THE DRAWINGS

The present invention will be described more fully with reference to the three accompanying sheets of drawings, in which.

DESCRIPTION OF PREFERRED EMBODIMENTS

Figure 1:
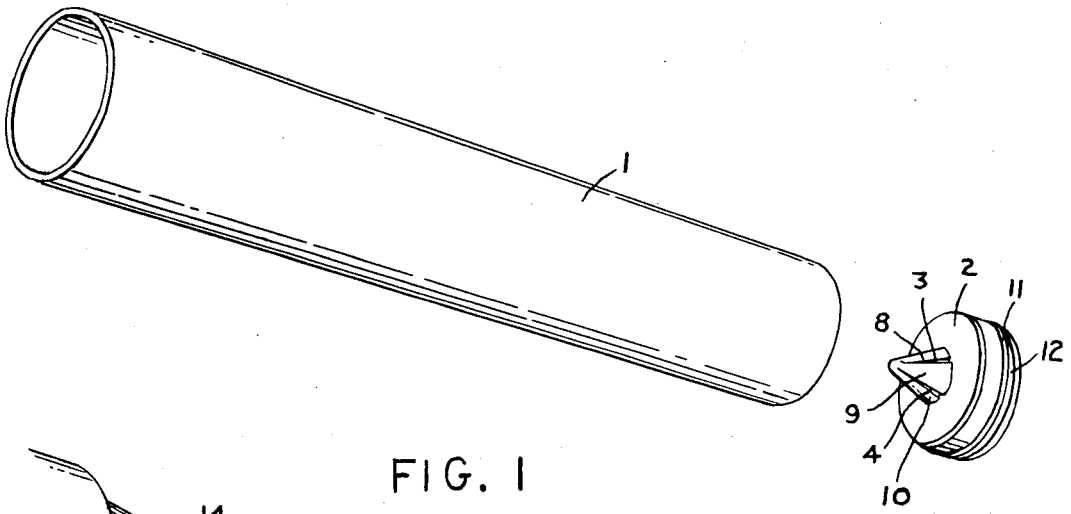
FIG. 1 shows a tube according to the present invention, together with an end closure not yet in place.
Figure 2:
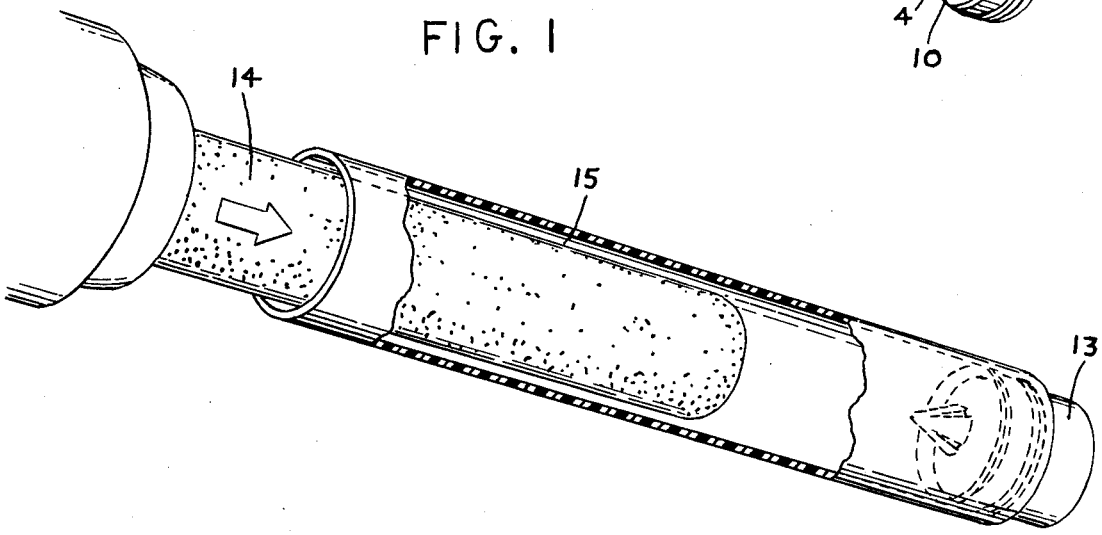
FIG. 2 shows the same tube as in FIG. 1, partially broken away and in section, where said end closure is in position and the explosive is being inserted into the tube.

In the drawings, numeral 1 denotes a tube of olefin plastic, and in the embodiment shown, polypropylene. Of course, the tube may be of any other type of plastic whatsoever which has the same properties as polypropylene. The tube 1 is manufactured by extruding it in such a way that the plastic molecules in the tube are orientated in both axial and radial direction. Furthermore, the molecules in the tube are not stressed but are unstressed, that is to say the tube can be extended without breaking and, because the molecules are not stretched and therefore have a certain elasticity, the tube can withstand considerable shock stress without breaking.

The tube has the following physical properties at 23° C. at a relative humidity of 50%

| | | | |
|---|---|---|---|
| Tensile stress: | MPa | DIN 53 455 | 27 |
| Yield point | % | DIN 53 455 | ca 900 |
| Flexural strength | MPa | DIN 53 452 | 32 |
| Torsional rigidity | MPa | DIN 53 447 | 300 |
| Bend-shrink modulus | MPa | | 1000 |
| Permeability to water vapor | $g/m^2$(24h, 25° C.) | DIN 50 122 | 0.81 |
| Permeability to water vapor | $g/m^2$(24h, 40° C.) | DIN 50 122 | 3.30 |

The layer thickness should be 0.04 mm and stretched.

The tube 1 also has such properties that it is not in any way affected by the constituents included in explosives sold under the trademarks DYNAMEX, GURIT and NABIT.

At the right of FIG. 1 an end closure 2 is shown which is in the form of a tubular part closed at the lefthand end and having a protuberance in the end closure. The protuberance is provided with a number of rupture indications 3, 4, 5 and 6. These four rupture indications define four flaps 7, 8, 9 and 10. The end closure 2, which may also be termed the end piece, is provided with two peripheral ridges or grooves 11 and 12. The end closure 2 is inserted into the righthand end of the tube 1. Upon insertion the peripheral ridges 11 and 12 will be in close contact with the inner surface of the tube 1. A mandrel 13 is inserted into the inserted end piece and provides contact surface for both the tubular part of the end closure and the tube 1. The end piece is then welded ultrasonically to the tube 1 via the peripheral ridges 11 and 12. The endpiece 2 and tube 1 form a single, coherent, homogenous unit at the welding points. The frequency and amplitude during welding should be chosen to suit the selected plastic material, polypropylene. This has the great advantage that all other material is removed from the welding point.

The tube 1 may have a diameter between 11 and 63 mm and a length of between 400 and 1200 mm. A suitable thickness for the tube may be between 0.35 and 0.55 mm.

Figure 3:
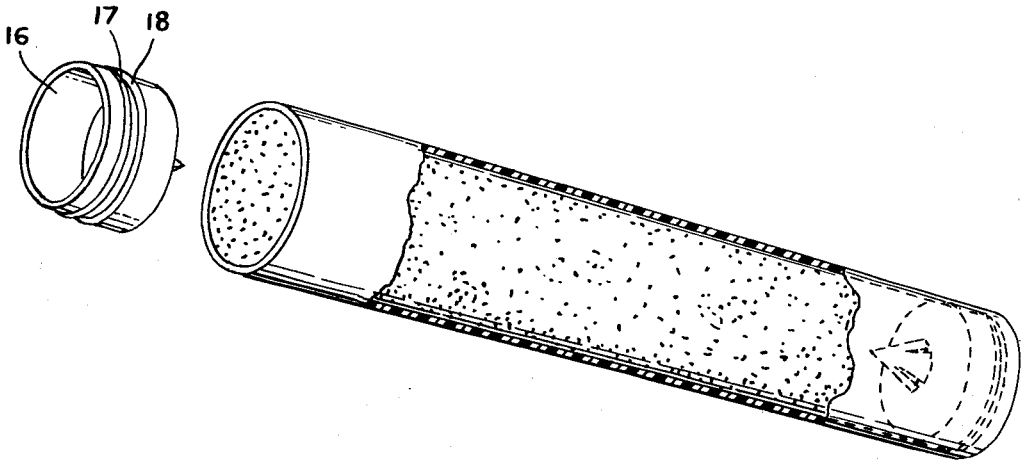
FIG. 3 shows the tube in FIG. 2 completely filled with explosive and with a second end closure ready to be secured on the tube.
Figure 4:
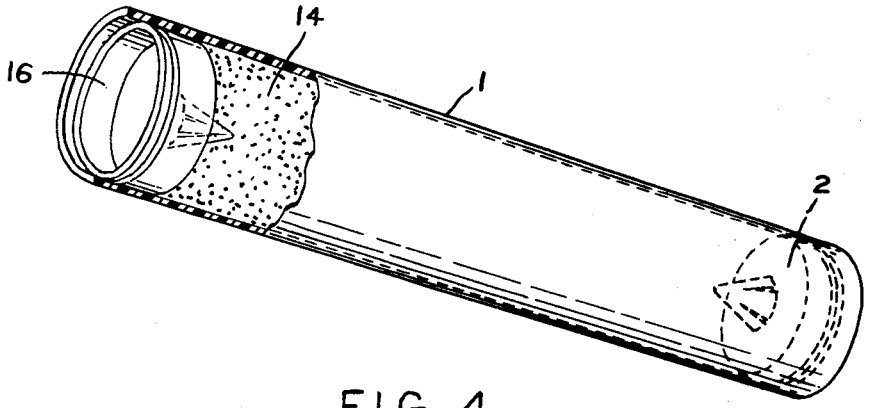
FIG. 4 shows the tube according to FIG. 1 completely filled and provided with two end closures.

When the end piece 2 has been welded to the tube 1, the tube 1 is filled with explosive in the form of a string 14 to leave a tubular space 15 between the tube 1 and the string 14 of explosive substance allowing air to be removed therethrough. FIG. 3 shows a tube completely filled with explosive 14. The tube 1 is then provided with a second end closure 16, also provided with two outwardly directed ridges or grooves 17 and 18. This end closure 16 can be pressed into the tube 1 so that the outer edge of the end closure 16 coincides with the lefthand outer edge of the tube 1 as shown in FIG. 4. When the end closure 16 is to be welded to the tube with ultra-sound, the mandrel 13 is applied first, after which welding is performed. This is shown in FIG. 4. An explosive container in accordance with a FIG. 4 can be sent to a country with tropical climate without the container being destroyed or the explosive damaged. Thanks to the choice of material used for the tube 1, this is not affected by the explosive inside but remains intact and has the same flexibility and elasticity as the explosive itself. Because of the changes in temperature during a 24-hour period in tropical climates, is it impossible to avoid the crystal conversions of ammonium nitrate existing in the explosive, as mentioned above, which result in the explosive in the tube expanding to a certain extent. Since the molecules in the surrounding tube are not stressed prior to arrival in the tropical climate, the surrounding tube is able to withstand the expansion in volume of the explosive enclosed. Furthermore, the explosive will remain plastic since the sealed container is unable to absorb liquid.

Figure 5:
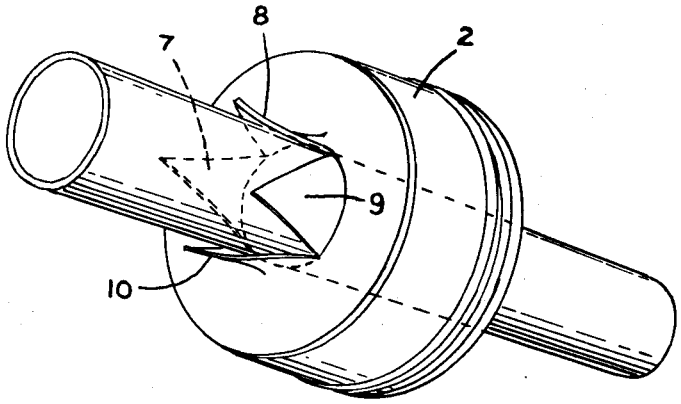
FIG. 5 shows and end closure with an inserted detonator held in position by the end closure.

The present invention therefore enables drill holes to be filled in countries having tropical climate by the method of using charges which are plastic and able to follow the unevenness in any drill hole. A detonator is generally inserted in the inserted charge first and this is done by inserting the detonator through the central protuberance in an end closure in the manner shown in FIG. 5.

Figure 6:
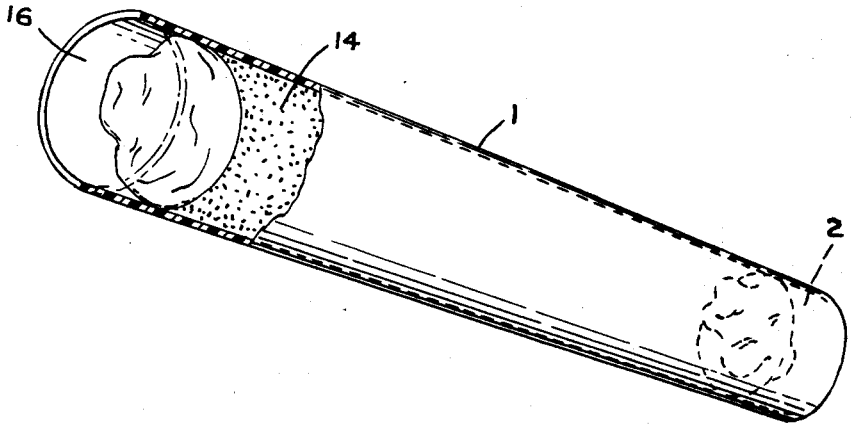
FIG. 6 shows a tube filled with explosive and sealed by end closures, in which the end closures have been influenced by expanded explosive.

Should the elongation capacity of the container, contrary to expection, prove to be insufficient, the end closures can always be deformed and take up a part of the expansion in volume of the explosive, as shown in FIG. 6.

It should be clear that the problems which have existed in connection with explosive substances may also exist when packing other substances into tubes, which are subjected to changes when transported to countries with tropical climates and where they must be stored for some time. The tubular container should in this case be resistant to chemical action from the contents and should also be able to withstand alterations in volume of the contents.

In the above it has been assumed that the tube has a circular cross-section but it is obvious that it may have any cross-section whatsoever without falling outside the scope of the present invention. For instance, the cross-section may be oval, circular, triangular, etc.

It has been mentioned above that olefin plastics shall be used. Examples of other plastics fulfilling the same function are polyacetate plastic, polyoxymethylene, both polymers and copolymers being suitable. Also possible are polyesters which can be injection molded and which are sold under the following trademarks: ULTRADUR and FORVENDO. Another possible plastic is polymethylepentene TPX.

I claim:

1. A tubular container for an expandible product, said container comprising a tube having opposite ends, end closure means at said ends, and an expandible product in said tube capable of exerting pressure on said end closures in the course of expansion of said expandible product, said tube being constituted of an olefin plastic whose molecules are oriented in both axial and radial directions, said molecules being unstretched and of a form which is substantially sine shaped.

2. Tubular container according to claim 1 wherein at 40° C. the olefin plastic has a permeability to water not exceeding 3.30 g per $m^2$ during a 24-hour period with a layer thickness of 0.04 mm, stretched.

3. Tubular container according to claim 1 or 2, wherein the end closure means of the tube consist of the same material as the tube itself.

4. Tubular container according to claim 3, wherein each end closure means comprises an inverted lid with a tubular part inserted in each end of the tube, the tubular part of the lid being in contact with the inner surface of the tube.

5. Tubular container according to claim 4, wherein the tubular part of each lid is welded to the surrounding tube.

6. Tubular container according to claim 5, wherein the tubular part of each lid is provided with at least one outwardly directed radial ridge which is welded to said tube.

7. Tubular container according to claim 5, wherein the lid is ultrasonically welded to the tube.

8. Tubular container according to claim 4 wherein each lid is provided with a central section facing inwardly in relation to the tube container and having rupture indications to enable penetration of a detonator and retention thereof.

9. Tubular container according to claim 1 wherein the expandible product is an explosive comprising ammonium nitrate and the olefin plastic is inert with respect to the explosive.

10. Tubular container according to claim 9 wherein the plastic consists of polypropylene.

11. Tubular container according to claim 9 wherein the plastic consists of copolymer of at least two different olefins.

12. Tubular container according to claim 1 wherein the olefin plastic has a glass temperature below −10° C.

* * * * *